US012540789B2

(12) United States Patent
Storch

(10) Patent No.: US 12,540,789 B2
(45) Date of Patent: Feb. 3, 2026

(54) FIREARM RECEIVER COVER AND CLOSURE ASSEMBLY

(71) Applicant: Midwest Industries, Inc., Waukesha, WI (US)

(72) Inventor: Troy Storch, Wales, WI (US)

(73) Assignee: Midwest Industries, Inc., Waukesha, WI (US)

( * ) Notice: Subject to any disclaimer, the term of this patent is extended or adjusted under 35 U.S.C. 154(b) by 0 days.

(21) Appl. No.: 18/131,214

(22) Filed: Apr. 5, 2023

(65) Prior Publication Data

US 2024/0337460 A1 Oct. 10, 2024

(51) Int. Cl.
*F41A 35/02* (2006.01)
*F41G 11/00* (2006.01)

(52) U.S. Cl.
CPC ..... *F41A 35/02* (2013.01); *F41G 11/003* (2013.01)

(58) Field of Classification Search
CPC ..... F41A 35/02
See application file for complete search history.

(56) References Cited

U.S. PATENT DOCUMENTS 4,845,871 A 7/1989 Swan
5,343,650 A 9/1994 Swan
5,522,166 A 6/1996 Martel
5,595,011 A 1/1997 Gorslin
6,381,895 B1 5/2002 Keeney et al.
6,854,206 B2 2/2005 Oz
7,062,876 B2 6/2006 Wilson
7,076,907 B2 7/2006 Nesseth et al.
8,117,954 B1 * 2/2012 Davis ..... F41A 3/72 89/1.4
8,266,998 B1 * 9/2012 Davis ..... F41A 3/72 89/1.4
8,407,925 B2 * 4/2013 Fesas ..... F41A 3/66 42/75.01
10,018,445 B2 * 7/2018 Fesas ..... F41A 13/00
10,030,938 B2 * 7/2018 Faifer ..... F41A 3/66
10,598,464 B2 * 3/2020 Faifer ..... F41G 11/004
10,809,038 B2 * 10/2020 Geissele ..... F41C 23/16
11,143,478 B2 * 10/2021 Downey ..... F41A 21/485
11,656,059 B1 * 5/2023 Ding ..... F41C 27/00 42/71.01
11,703,308 B2 * 7/2023 Ding ..... F41G 11/003 42/90
11,768,045 B2 * 9/2023 Makarov ..... F41A 15/20 42/17
11,796,282 B1 * 10/2023 Ding ..... F41C 23/16
(Continued)

*Primary Examiner* — Michelle Clement
(74) *Attorney, Agent, or Firm* — Boyle Fredrickson, S.C.; Kirk L. Deheck

(57) ABSTRACT

A firearm receiver cover and closure assembly that allows the cover to be moved between respective open and closed positions relative to an underlying receiver. The closure assembly includes a latch that defines a latch button that cooperates with a latch button opening formed in the cover. Cooperation of the latch with the receiver and the cooperation of the latch button with the latch opening formed in the cover provide fixed and repeatable vertical and lateral positioning of the cover relative to the underlying receiver, without adjustment or operation of a centering mechanism or structure, during each closing of the cover relative to the underlying receiver.

12 Claims, 6 Drawing Sheets

(56) References Cited

U.S. PATENT DOCUMENTS

| | | | | |
|---|---|---|---|---|
| 12,104,872 | B1 * | 10/2024 | Bray | F41A 3/66 |
| 12,130,104 | B2 * | 10/2024 | DeVoe | F41A 17/76 |
| 2022/0290936 | A1 * | 9/2022 | Kellgren | F41A 9/17 |
| 2022/0364810 | A1 * | 11/2022 | Stenzel | F41A 35/06 |
| 2023/0184517 | A1 * | 6/2023 | Davis | F41G 1/02 42/90 |

* cited by examiner

FIREARM RECEIVER COVER AND CLOSURE ASSEMBLY

BACKGROUND OF THE INVENTION

The present invention relates generally to a cover and closure arrangement that is constructed to facilitate securing accessories such as sights, lights, shell holders, or other accessory mounting assemblies in a secure usable manner to an underlying firearm. Many firearm platforms incorporate one or more military standard 1913 (MIL-STD-1913), commonly referred to as a picatinny rail, or other repeating shaped accessory mounting rails that are constructed to accommodate the securing of one or more firearm accessories to an underlying firearm in a secure manner. Although the engagement interface defined by the picatinny or other accessory rail mounting systems is prolific in many firearm configurations and firearm accessory mounting arrangements and accessories, the picatinny rail and other rail engagement configurations present unique drawbacks attenuate to the construction of underlying commercially available firearm configurations.

For instance, the AK-47 firearm platform is one type of rifle configuration that presents several complications associated with securing accessories to the underlying firearm. Lauded advantages of the AK firearm system include a relatively low manufacturing cost and a simple but versatile construction and operation. A portion of these advantages stem from employment of larger than ordinary manufacturing and operating tolerances in the manufacture, assembly, and operation of the resultant firearm. By some user's, the advantages of serviceability of the firearm are outweighed by reliability issues associated with its operation. The construction of the AK-47 includes a movable or removable cover that extends along a majority of the upper surface of the receiver assembly. Removal or opening of the cover is commonly effectuated in a tool-less manner and provides the user with convenient and expedient access to the assemblies and components that generally underlie the cover including the receiver, a bolt, a charging system, a magazine tunnel, and a trigger system. The tool-lessly openable and closable nature of the cover facilitates convenient cleaning and/or service operations associated with maintaining the desired operation of the underlying firearm. Although the operable cover provides expedient access to the operating systems of the underlying firearm, the moveable nature of the cover relative to the underlying firearm, compounded by the larger tolerances employed during the manufacture and assembly, detracts from the ability, or the desire, of the user to employ those areas defined by the moveable cover for supporting accessories, particularly sighting aids and accessories, relative to the underlying firearm. That is, the larger tolerances employed during manufacture of the AK firearm and the moveable nature of the cover detracts from a suitable degree of accuracy associated with repeatable positioning of those sighting accessories secured to the firearm cover between cover opening and closing operations and fail to provide a sufficiently rigid association of the sighting accessories to the bore of the firearm during operation of the firearm and thereby detract from the desired accuracy associated with operation of the firearm rending the original equipment manufacturer (OEM) receiver cover unsuitable for the securing of sighting accessories to the underlying firearm.

Desired usage of most firearms is the quick and repeatable acquisition of a target and delivery of the projectile accurately to an intended target. Many users employ various sighting aids to assist in the accurate delivery of projectiles within the operating range of the underlying firearm. Employment of such sighting devices requires the rigid association of the sighting aid to the underlying firearm. As eluded to above, firearms equipped with moveable covers or other assemblies, and firearms manufactured with larger manufacturing tolerances, detract from the objectives associated with use of such sighting aids when such sighting aids are intended to be secured to underlying movable structures of the firearm assembly. Further still, the moveable structures intended to improve access to the underlying movable or independently operable sub-assemblies of the firearm are commonly provided at locations more proximate the user and at customary locations associated with mounting of such accessories for use of the resultant firearm. Others overcome considerations associated with the rigid mounting of the sighting accessories to the underlying firearm by mounting such assemblies to fore grips of the underlying firearm. Such approaches detract from ergonomic usage of the firearm and sighting accessories and detrimentally affect the resultant balance of the firearm. Others disclose accessory mounting and cover constructions intended to over the shortcomings associated with secure and rigid mounting of the sighting accessories to the moveable structures of the firearm but present shortcomings unique to their respective proposed constructions.

One such approach is disclosed in U.S. Pat. No. 8,407,925. As disclosed therein, the movable cover of the underlying firearm assembly includes a picatinny rail formed along the upward directed surface of the receiver cover. The cover is pivotably connected to the firearm at a location forward of the OEM rear iron sight of the AK-47 and includes a tool-lessly operable latch that removeably cooperates with an opening formed in a rear of the cover. Recognizing the larger manufacturing tolerance common to the construction of AK-47 firearms, the cover disclosed therein includes a spring slot formed in a lower leading edge of one edge of the cover. Centering of the cover disclosed in the '925 patent relative to the underlying receiver relies upon user deflection of the spring side panel of the cover relative to the receiver and the opposing side panel of the cover relative to the receiver. The '925 patent further discloses that the amount of force exerted upon the receiver by the structure adjacent the spring slot can be increased or decreased by adjusting the size of the protrusion associated with the spring slot. Such an approach suffers from various drawbacks unique to the construction and operation thereof.

Adjusting the force exerted upon the receiver with the protrusion associated with the spring slot localizes forces associated with lateral positioning of the cover relative to the receiver and can exacerbate wear between the protrusion and the receiver associated with the repeated opening and closing of the cover relative to the receiver. Exacerbated wear between the protrusion and the receiver detracts from securable repeatable lateral association of the cover relative to the receiver and results in adjustment of the lateral spring pressure attributable to the protrusion. Further, subjecting the structure of the cover, or accessories engaged therewith, to lateral forces or unexpected lateral impacts, can inadvertently adjust the retaining force associated with lateral positioning of the cover relative to the receiver. That is, the energy associated with such forces are wholly bore by the limited structure of the protrusion associated with the spring slot. Without attention and/or if sever enough, such impacts can inadvertently adjustment the lateral pressure attributable to cooperation of the protrusion with the receiver and can result in inaccuracy or variability associated with usage of sighting accessories secured to the firearm via the movable cover.

Further still, once individualized by manipulation of the relative position of the protrusion of the cover relative to an underlying receiver, detracts from the interchangeability of the cover assembly for use with other OEM AK-47 firearms without further adjustment of the relative position of the protrusion. Repeatable adjustment of the relative position of the protrusion relative to the remainder of the cover can further operate to weaken the holding force associated with the spring slot due to fatigue of the material associated with the protrusion along the deflection axis. Even further, moving the pivot axis associated with rotational motion of the cover relative to the receiver in the manner proposed by the '925 patent renders the AK-47 OEM firearm rear iron sight unusable and increases the load and forces bore by the spring slot and protrusion to maintain the desired lateral position of the cover relative to the receiver when the cover is oriented in the closed position due to the increased distance between the forward and rearward mounting structures associated with maintaining a desired and secure orientation of the cover, and those accessories associated therewith, relative to the receiver.

Therefore, there is a need for a firearm receiver cover assembly that is movable relative to an underlying receiver and does not interfere with or require alteration of the construction of an underlying firearm assembly. There is a further need for a firearm receiver cover assembly that provides a pivot and closure assembly that provides a secure, robust, and repeatable vertical and lateral alignment of the cover relative to the receiver when closed.

SUMMARY OF THE INVENTION

The present invention provides a firearm receiver cover and closure assembly that allows the cover to be moved between respective open and closed positions relative to an underlying receiver. The closure assembly includes a latch that defines a latch button that cooperates with a latch button opening formed in the cover. Cooperation of the latch with the receiver and the cooperation of the latch button with the latch opening formed in the cover provide fixed and repeatable vertical and lateral positioning of the cover, and any accessories supported by the cover, relative to the underlying receiver and without adjustment or operation of a centering mechanism or structure, during each closing of the cover relative to the underlying receiver. In a preferred aspect, one or more of the latch button and the latch opening are defined by a frusto-conical, pyramidal, or tapered shapes that slideably cooperate with one another and operate to fix a vertical and lateral orientation of the cover relative to the receiver when the latch button and latch opening are engaged with one another.

One aspect of the invention discloses a firearm closure assembly having a cover that is defined by an elongate body and that is shaped to overlie at least a portion of a receiver of an underlying firearm. The elongate body of the cover has a rearward facing end portion and a forward-facing end portion that is generally opposite the rearward facing end portion of the cover. The forward-facing end portion is constructed to pivotably connect the elongate body of the cover to the underlying firearm. The assembly includes a latch that is constructed to be slideably disposed between the elongate body of the cover and the receiver and is slideable along an axis generally aligned with an elongate axis of the cover and such that the latch is positioned proximate the rearward facing end portion of the elongate body of the cover when engaged therewith. A pushbutton is defined by the latch and an opening is formed in the rearward facing end portion of the cover. The opening in the cover is constructed to slideably cooperate with the pushbutton of the latch so that engagement between the pushbutton of the latch and the opening of the cover defines a lateral position of the cover relative to the receiver when the cover is engaged with the latch.

Another aspect of the invention discloses a firearm assembly having a receiver and a cover constructed to extend along an upper portion of the receiver. The cover is pivotably connected to an underlying firearm so that the cover is pivotable about a forward oriented pivot axis. An opening is formed in a rearward oriented portion of the cover and the assembly includes a latch that is configured to selectively engage the cover. A trunnion block is secured to the receiver and is constructed to engage the latch so that the latch is slideable relative to the trunnion block in a direction that is transverse to the forward oriented pivot axis. A button is defined by the latch and is shaped to slideably cooperate with the opening formed in the cover so that the cover can rotate about the forward oriented pivot axis in a direction away from the receiver when the button is disengaged from the opening and so that engagement of the button defined by the latch with the opening formed in the cover defines a fixed non-adjustable lateral position and a fixed inclination of the cover relative to the receiver.

Another aspect of the present invention discloses a method of forming a firearm assembly that includes providing a cover that is shaped to overlie a portion of a receiver of a firearm and having a pivot axis formed at a forward oriented end portion of the cover and a latch opening formed at a rearward oriented end portion of the cover. The method includes providing a latch that is shaped to be disposed between the receiver and the cover such that the latch is slideable relative to the cover and the receiver. The latch defines a latch button that removeably cooperates with the latch opening formed in the cover. When engaged with one another, opposing lateral sides of the latch button engage with respective opposing lateral sides of the latch opening defined by the cover to define a fixed lateral position of the cover relative to the latch when the latch button is engaged with the latch opening.

These and other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
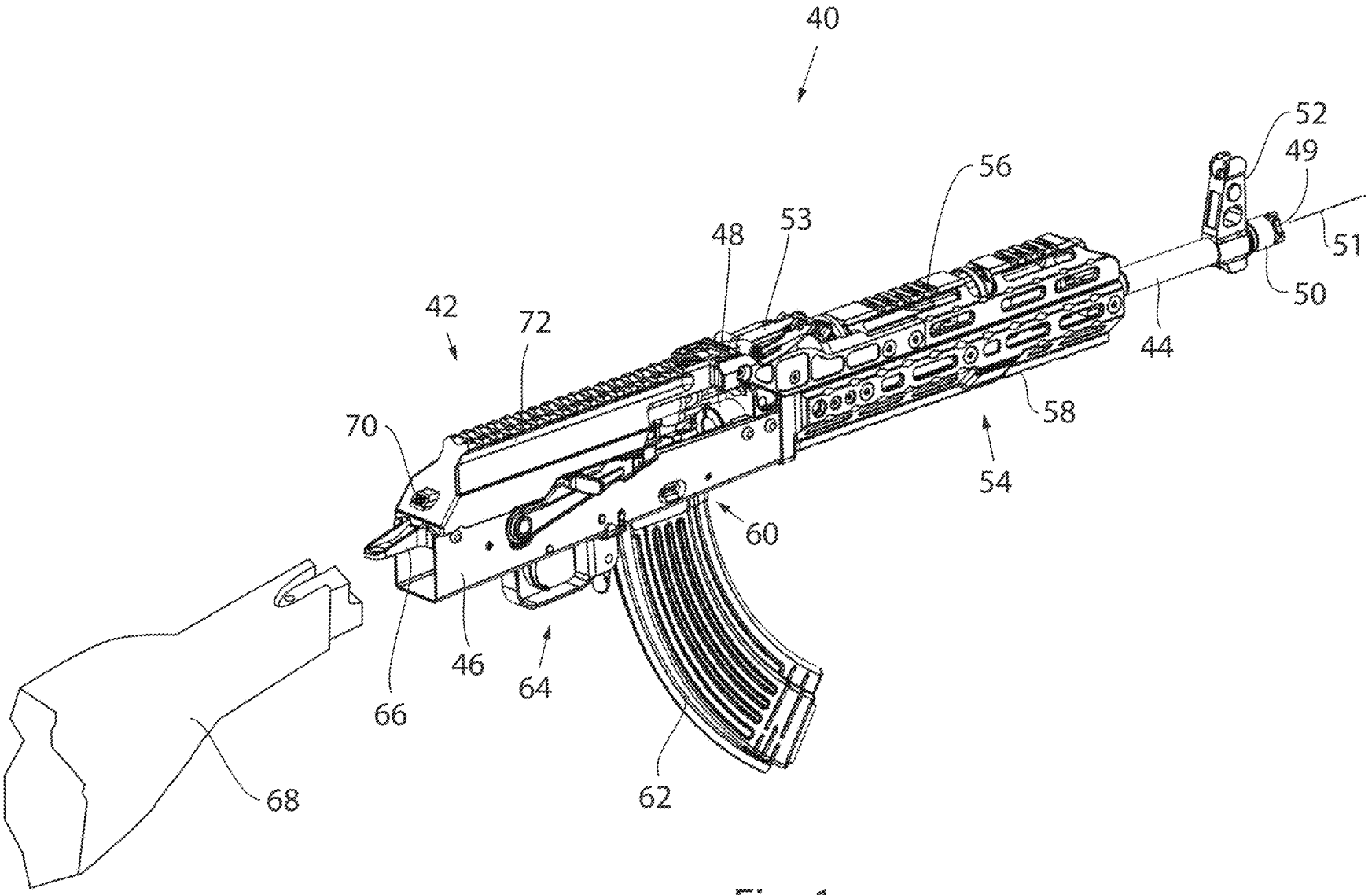
FIG. 1 is a rear perspective view of an exemplary firearm equipped with a receiver cover and latch assembly according to the present invention.
Figure 2:
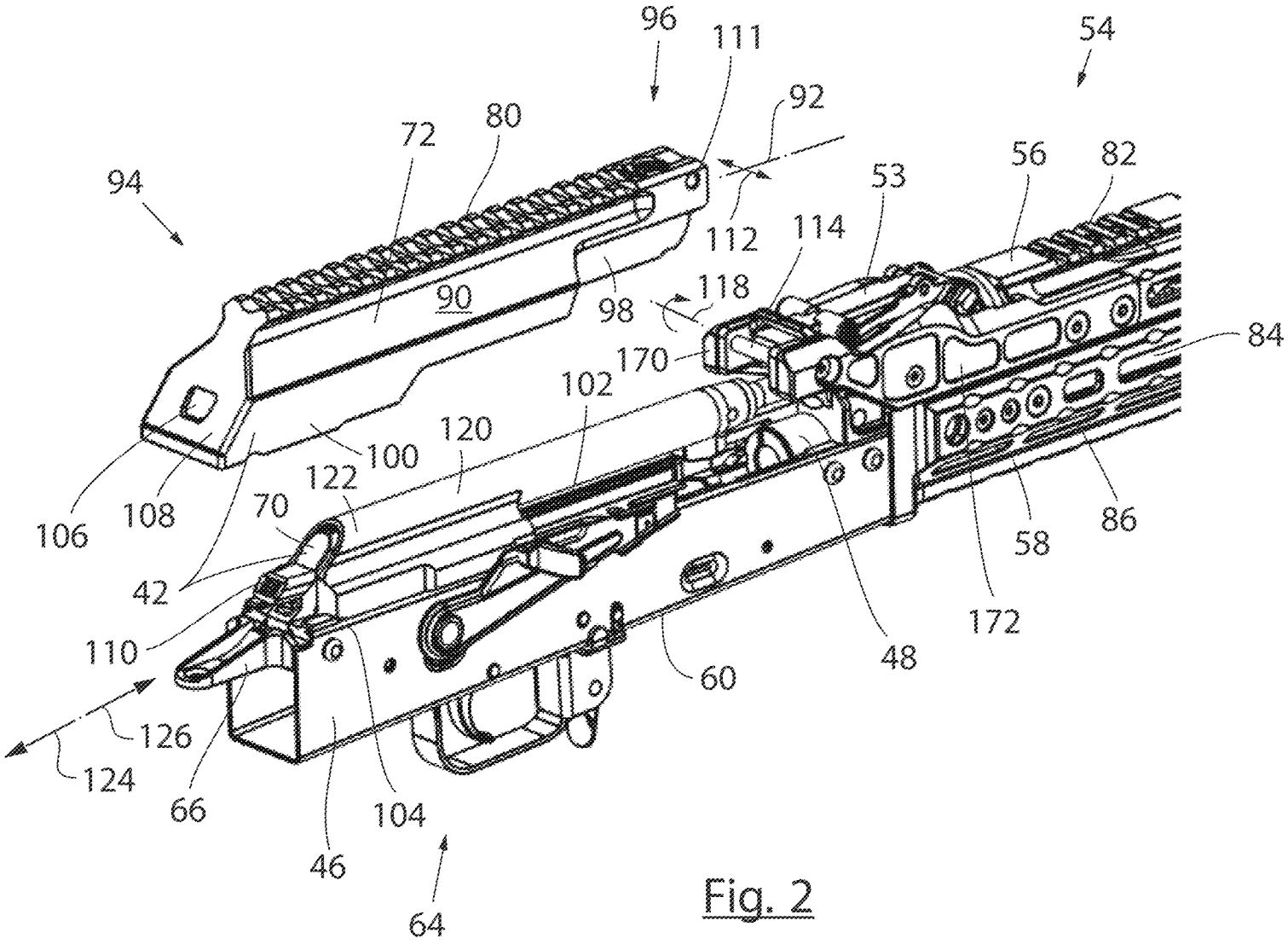
FIG. 2 is a view similar to FIG. 1 of the receiver portion of the firearm shown therein with the receiver cover exploded therefrom.

FIG. 1 shows an exemplary firearm 40 equipped with a receiver cover and cover latch forming a closure or receiver cover and latch assembly 42 according to the present invention. Referring to FIGS. 1 and 2, receiver cover and latch assembly 42 are secured to the underlying firearm 40 such that the receiver cover is pivotably or rotationally connected thereto. As disclosed further below, receiver cover and latch assembly 42 includes a latch 70 constructed to selectively cooperate with a receiver cover 72 such that receiver cover 72 is pivotable or rotatable relative to the underlying firearm 40 to allow convenient and expedient access to the area and those structures of firearm 40 that are disposed generally beneath or under receiver cover 72 when the cover is oriented in a closed position as shown in FIG. 1. Although shown as what should be readily appreciated as an AK-47 style rifle, it is appreciated that receiver cover and latch assembly 42 can be constructed to cooperate with other OEM firearms having moveable or selectively openable and closeable receiver cover assemblies. As disclosed further below, receiver cover and latch assembly 42 are constructed to effectuate repeatable centering or orienting of the receiver cover relative to the underlying firearm when engaged with the latch without any ancillary adjustment thereto.

Firearm 40 includes a barrel 44 that extends between a cartridge end 48 that is configured to receive the cartridge and constructed to be secured to receiver 46. A muzzle 50 is defined at an opposite end of barrel 44 and is associated with the egress of projectiles from firearm 40. Barrel 44 defines a bore 49 associated with the direction of travel of projectiles discharged from firearm 40. Bore 49 defines the longitudinal axis, indicated by line 51, associated with the direction of travel of projectiles discharged from firearm 40, excluding extraneous factors such as gravitational drop and windage, and is indicative of the longitudinal axis of firearm and the axis of projectile travel. A forward sight 52 is secured to barrel 44 proximate muzzle 50 and cooperates with a rear sight 53 to assist the user in alignment of bore 49 with a desired target during use of firearm 40. Firearm 40 includes a foregrip assembly 54 that is secured to barrel 44 and/or receiver 46 such that foregrip assembly 54 is oriented forward of receiver 46 and has a position and orientation that is intended to be fixed relative to barrel 44. Foregrip assembly 54 includes an upper foregrip or upper hand guard 56 and a lower hand guard 58 that are secured to firearm 40 and preferably secured to one another. It is appreciated that foregrip assembly 54 could be provided in an one-piece construction.

Generally rearward of foregrip assembly 54, receiver 46 defines a magazine tunnel 60 that is constructed to removably cooperate with a magazine 62 associated with sequentially delivering ammunition to firearm 40 during use thereof. A trigger assembly 64 is positioned generally rearward of magazine 62 and is also supported by receiver 46. As is commonly understood, operation of trigger assembly 64 effectuates the discharge of ammunition associated with the chamber of the underlying firearm via operation of the bolt and firing pin of the underlying firearm. It is appreciated that such firearms can be provided in automatic, semiautomatic automatic, and/or user manual operation of the bolt associated therewith. That is, in some configurations, firearm 40 may be configured to chamber a subsequent round of ammunition automatically in response to the discharge of an immediately preceding round of ammunition or be configured as a bolt action wherein user interaction with the bolt or bolt carried is required to effectuate ejection of a spent shell casing and introduction of a subsequent round to the firing chamber.

Regardless of the operating configuration, a rear trunnion 66 is secured to receiver 46 and is constructed to secure a stock 68 to firearm 40. As disclosed further below, rear trunnion 66 is also constructed to slideably cooperate with a latch 70 associated with receiver cover and latch assembly 42 to selectively secure receiver cover 72 in the closed position relative to receiver 46. The slideable cooperation between latch 70 and rear trunnion 66 preferably provides an orthogonally aligned association of latch 70 with firearm 40 with no more than a manufacturing tolerance of approximately 0.0010 to 0.0002 inches and more preferably about 0.0006 to 0.0004 inches tolerance therebetween. Preferably, the manufacturing tolerance associated with the slideable association of latch 70 with rear trunnion 66 is a minimum tolerable tolerance associated with maintaining a desired slideable association therebetween and wherein the axis associated with the slideable association is laterally and vertically aligned with the longitudinal axis 51 of firearm 40. It is further appreciated that the axis associated with the slideable association of latch 70 with rear trunnion 66 may be offset rather than provided in a colinear association with longitudinal axis 51. As disclosed further below, latch 70 is biased into engagement with receiver cover 72 to maintain the closed orientation of receiver cover 72 relative to firearm 40 but can be depressed by the user to selectively disengage the latch 70 from the receiver cover 72 such that the receiver cover 72 can be rotated to an open position thereby exposing those areas and structures of firearm 40 that are generally disposed underneath or shrouded by receiver cover 72 when receiver cover 72 is oriented in the closed orientation shown in FIG. 1.

Still referring to FIGS. 1 and 2, in a preferred embodiment, one of more surfaces of each of upper hand guard 56, lower hand guard 58, and receiver cover 72 include one or more accessory mounting arrangements 80, 82, 84, 86 that are constructed to allow the selective securing of shooting accessories to the underlying firearm 40. It is appreciated that mounting arrangements can be provided in various configurations such as a picatinny rail arrangement, such as arrangements 80, 82, or other mounting arrangements such as those defined by one or more openings or elongate slots, such as arrangements 84, 86. Regardless of the specific configuration, each of mounting arrangements 80, 82, 84, 86 are constructed to accommodate securing of shooting accessories or accessory mounts, such as tripods, lights, shell holders, sighting accessories, sight mounts, or the like to underlying firearm 40. It is further understood that those accessories associated with or otherwise secured to mounting arrangements 80, 82, being disposed along the top surface of firearm 40, can be configured to cooperate with or compliment use of sights 52, 53, or be independently usable relative thereto, when associated with firearm 40 when desired.

Figure 3:
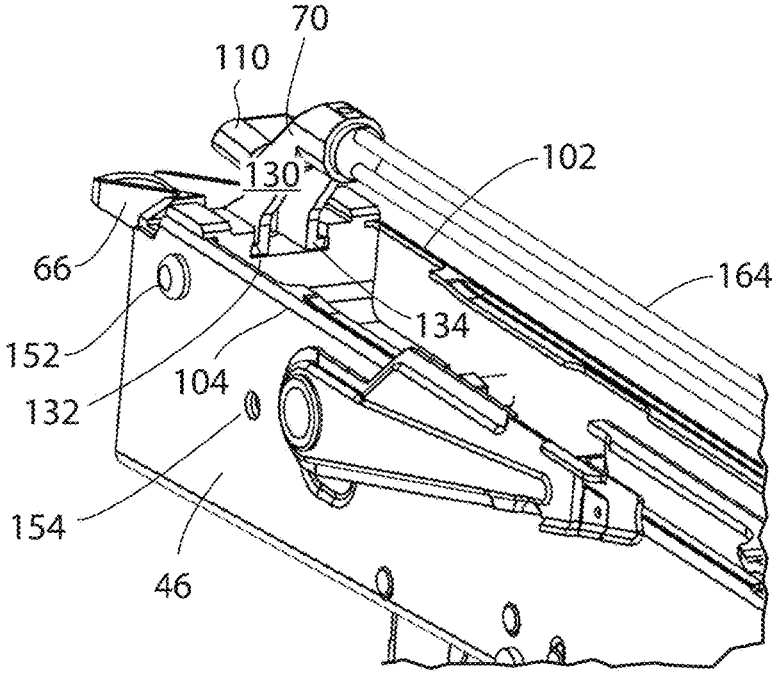
FIG. 3 is a perspective view of a rear portion of the receiver assembly shown in FIG. 2 with the receiver cover and a bolt carrier removed therefrom.

Referring to FIGS. 2 and 3, receiver cover 72 is generally defined by an elongate body 90 that extends in a longitudinal direction, indicated by line 92, that extends between a rearward-facing end 94 and a forward facing end 96 thereof. Opposite lateral sides of receiver cover 72 generally define a first skirt portion 98 and the second skirt portion 100 that are oriented to cooperate with, or slightly overhang, an upward directed edge 102 associated with a respective opposing lateral side of receiver 46. An opening 106 is formed in a rearward facing sidewall or surface 108 of receiver cover 72 and is shaped to cooperate with a button portion 110 defined by latch 70. As disclosed further below, button portion 110 of latch 70 and opening 106 of receiver cover 72 cooperate in a manner that substantially fixes and establishes a non-adjustable relative vertical and lateral position of rearward facing end 94 of receiver cover 72 relative to the underlying firearm 40 when button portion 110 is engaged with opening 106 formed in receiver cover 72.

As shown in FIG. 2, forward facing end 96 of receiver cover 72 includes a passage 111 formed through body 90 of receiver cover 72. Passage 111 extends in a lateral direction, indicated by line 112, that is orthogonal to longitudinal axis 92 of body 90 of receiver cover 72. A pivot or pivot pin 114 passes through passage 111 of receiver cover 72 and is secured to foregrip assembly 54 at a location generally rearward of rear sight 53. Engagement of pivot pin 114 with passage 111 allows receiver cover 72 to pivot or rotate about an axis, indicated by line 118, defined by pivot pin 114 when receiver cover 72 is secured to firearm 40 and latch 70 is disengaged from the opening 106 associated with the rearward facing end 94 of receiver cover 72. The cooperation of receiver cover 72 with pivot pin 114 provides a secure and robust mounting arrangement associated with the forward end of receiver 46 and provides a robust but movable orthogonal association of receiver cover 72 relative to the underlying firearm 40 when secured thereto. That is, cooperation between receiver cover 72 and pivot pin 114 secures the forward facing end 96 of receiver cover 72 relative to firearm 40 in a manner that mitigates longitudinal twisting as well as lateral, vertical, and longitudinal translation of the forward oriented mounting location associated with the forward securing of receiver cover 72 to firearm 40 but in a manner that accommodates the rotational or pivotable motion of receiver cover 72 relative to firearm 40 to expose those features and structures thereunder when desired or necessary.

A bolt carrier 120 is disposed generally beneath receiver cover 72 and is constructed to accommodate slidable operation of a bolt associated with the underlying firearm 40 during operation thereof. A rearward oriented end 122 bolt carrier 120 is shaped to slidably cooperate with latch 70 such that latch 70 is slidable in a rearward direction, indicated by arrow 124, and a forward direction, indicated by arrow 126, relative to bolt carrier 120, to allow the selective engagement and disengagement of latch 70 from receiver cover 72 when desired. As disclosed further below, user interaction with button portion 110 of latch 70 allows selective user interaction with button portion 110 to allow the selective disengagement of button portion 110 from interaction with opening 106 defined by receiver cover 72 to accommodate the selective upward and forward rotation of the rear facing end 94 of receiver cover 72 about axis 118 defined by pivot pin 114 during receiver cover opening operations.

Figure 4:
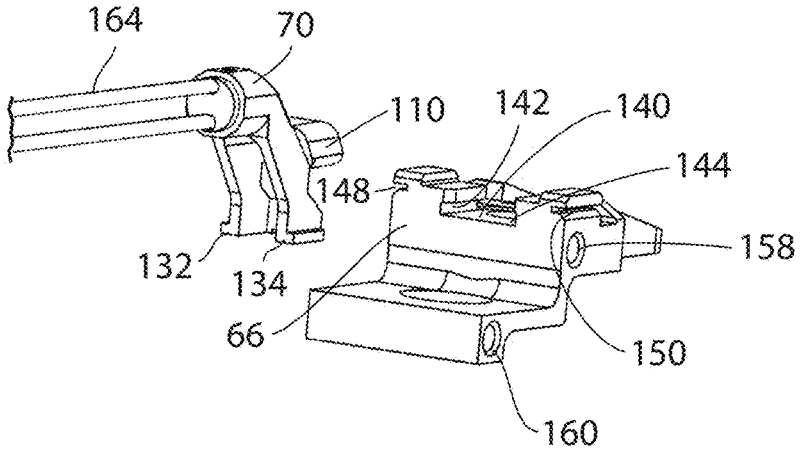
FIG. 4 is a perspective view of a cover latch and rear trunnion of the firearm shown in FIGS. 1 and 2.

Referring to FIGS. 3 and 4, latch 70 is defined by a body 130 having respective legs 132, 134 formed a lower end thereof. Legs 132, 134 include portions that extend in respective opposite outward lateral directions and slideably cooperate with a channel 140 defined by rear trunnion 66. Rear trunnion 66 includes respective channels 142, 144 that are shaped to slidably cooperate with the laterally outward extending portions of respective legs 132, 134 defined by latch 70 in at least a partially overlapping manner. Preferably, the tolerance associated with the slidable interaction between latch 70 and channel 140 is approximately about 0.0005 inches and preferably no greater than 0.0005 inches therebetween. The slidable cooperation between latch 70 and rear trunnion 66 thereby generally defines the lateral and vertical orientation of latch 70 relative to rear trunnion 66 and thereby receiver 46 of firearm 40. Rear trunnion 66 preferably includes respective laterally outward oriented channels 148, 150 shaped to cooperate with respective upward directed edges 102 of the sidewalls of receiver 46. One or more fasteners 152, 154 cooperate with respective passages 158, 160 associated with rear trunnion 66 such that rear trunnion 66 can be securely positionally oriented relative to receiver 46 when secured thereto. As disclosed further below, a spring guide 164 extends in a forward direction from latch 70 within a cavity defined by bolt carrier 120. As disclosed further below with respect to FIG. 11, a spring associated with the automatic cyclic operation of the bolt of the underlying firearm is disposed about spring guide 164 and is oriented to bias latch 70 in rearward direction 124 relative to rear trunnion 66. When receiver cover 72 is oriented in the closed position relative to latch 70, the spring biases button portion 110 of latch 70 into operative engagement with the opening 106 formed in the rearward facing surface 108 of receiver cover 72 thereby maintain the receiver cover 72 in the closed orientation relative to receiver 46.

Figure 5:
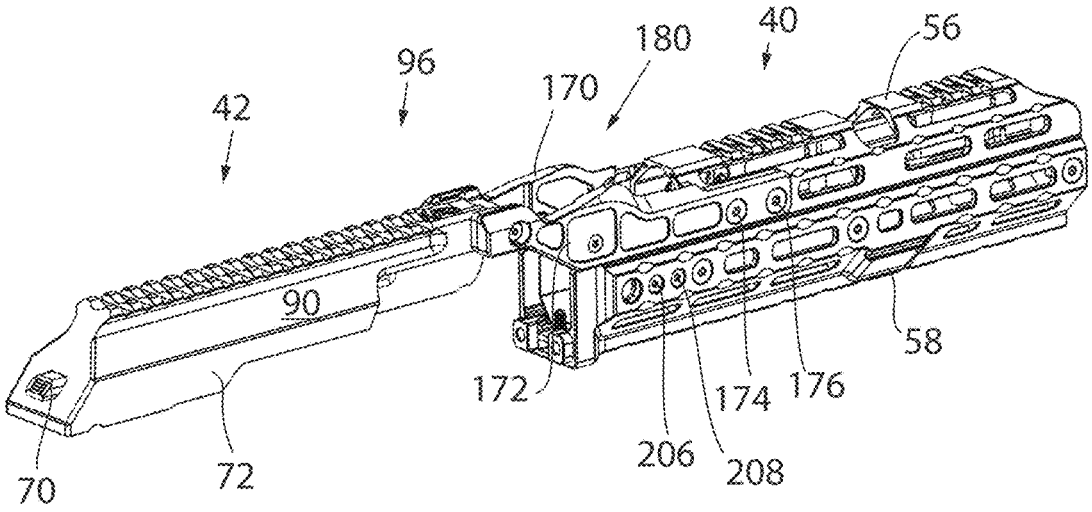
FIG. 5 is a perspective view of a foregrip assembly, receiver cover assembly; and cover latch removed from the firearm shown in FIGS. 1 and 2.
Figure 6:
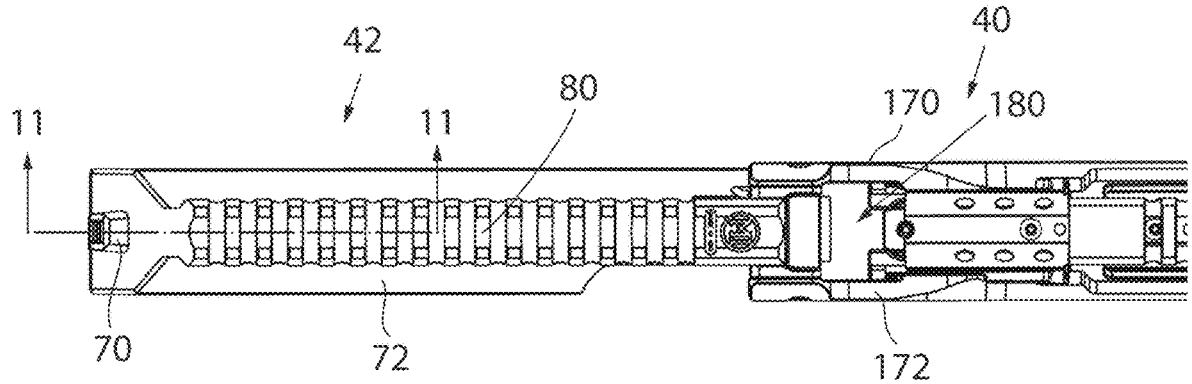
FIG. 6 is a top plan view of a portion of the foregrip, receiver cover, and cover latch assembly shown in FIG. 5.

FIGS. 5 and 6 show respective views of receiver cover and latch assembly 42 and foregrip assembly 54 removed from firearm 40. A pair of respective mount brackets 170, 172 are secured to upper hand guard 56 by one or more fasteners 174, 176 and extend in a rearward direction therefrom to cooperate with and support forward facing end 96 of body 90 receiver cover 72. When secured to foregrip assembly 54 and receiver cover 72, mount bracket 170 and mount bracket 172 define a sight cavity 180 that is generally laterally centered and longitudinally disposed therebetween. Sight cavity 180 accommodates use of receiver cover and latch assembly 42 in cooperation and utilization of OEM rear sight 53 associated with an underlying firearm 40, replacements or alternatives thereof, and/or compliments or augmentations associated therewith via the engagement of one or more sighting accessories secured to accessory mounting arrangement 80 of receiver cover 72 such that sighting accessories can be oriented laterally aligned with or laterally offset from sighting cavity 180 but such that such accessories can be disposed rearward or toward the user relative to an OEM or other suitable rear sight associated with cavity 180. Such a consideration improves the longitudinal ergonomic balance associated with use of firearm 40 when accessories are associated with and supported by receiver cover 72.

Figure 7:
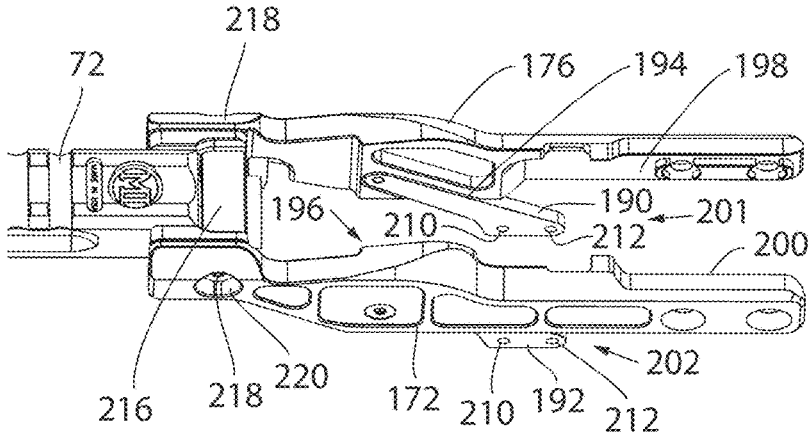
FIG. 7 is a perspective view of a forward-facing portion of the receiver cover assembly shown in FIG. 5.
Figure 8:
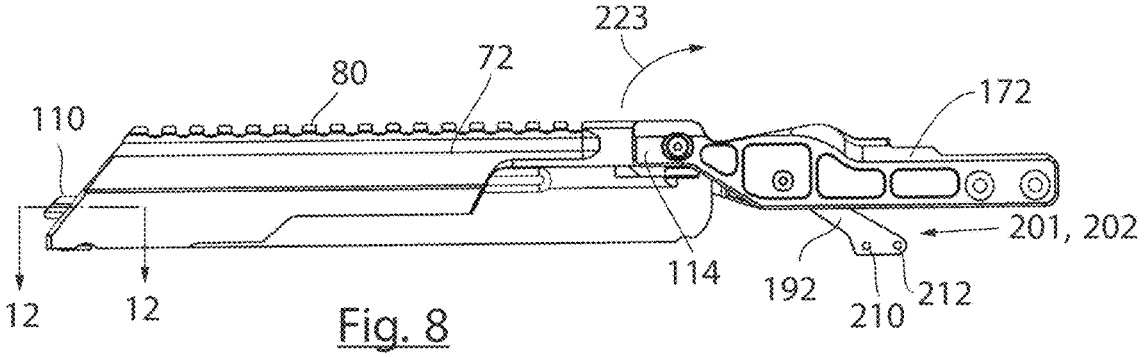
FIG. 8 is a side elevation view of the receiver cover assembly shown in FIG. 5.
Figure 9:
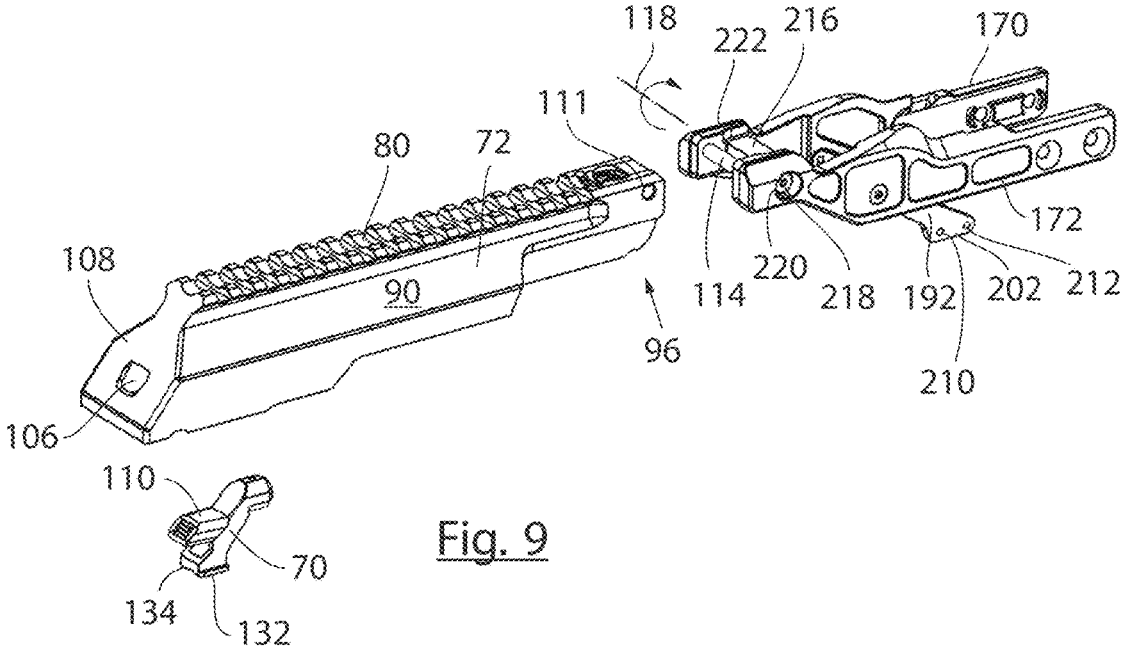
FIG. 9 is a partially exploded perspective view of the receiver cover assembly shown in FIG. 8.

Referring to FIGS. 7, 8, and 9, one or more respective braces 190, 192 is/are constructed to cooperate with a respective cavity 194, 196 formed on an interior facing surface 198, 200 of a respective one of brackets 170, 172. Each brace 190, 192 includes a lobe 201, 202 that extends downwardly generally behind the respective bracket 170, 172 and cooperates with a correspondingly shaped cavity formed on an interior facing surface associated with the opposite lateral sides of a lower foregrip or lower hand guard 58 when secured thereto. Respective fasteners 206, 208 (FIG. 5) cooperate with respective holes 210, 212 (FIG. 7) formed in the respective lobes 200, 202 of respective braces 190, 192 such that braces 190, 192 are rendered securely supported by foregrip assembly 54.

A spacer 216 is disposed between brackets 170, 172 proximate pivot pin 114. Respective fasteners 218 cooperate with respective openings 220 and engage spacer 216 such that spacer 216 define a laterally extending gap 222 between brackets 170, 172 proximate pivot pin 114. During assembly, pivot pin 114 is associated with opening 111 formed in receiver cover 72 such that engagement of fasteners 218 with spacer 216 captures and secures forward facing end 96 of receiver cover 72 relative to bracket 170, 172 such that receiver cover 72 is rotatable about pivot pin 114 in a secure manner but such that receiver cover 72 remains rotatable or pivotable relative to brackets 170, 172 and motion of the receiver cover 72 is provided such that the centerline longitudinal axis of receiver cover 72 is maintained in a plane that is coincident with axis 51 associated with bore 49 of the underlying firearm 40. Said in another way, receiver cover 72 is preferably connected to and supported by foregrip assembly 54 such that receiver cover 72 rotates in a plane that is laterally aligned with the bore 49 of firearm 40. Cooperation of brackets 170, 172 and the indexed engagement of lobes 200, 202 provides a secure and robust connection and orientation of pivot pin 114, and thereby receiver cover 72, relative to the underlying firearm 40 when engaged therewith. Securing receiver cover 72 and the more rearward positioning of pivot pin 114 relative to foregrip assembly 54 shortens the relative longitudinal distance between the forward and rearward oriented mounting and securing locations associated with receiver cover 72 and thereby increases the ability of receiver cover 72 to withstand displacement should the receiver cover 72, or accessories associated therewith, be subjected to incidental impacts or the like and thereby better maintains an orthogonal association of the receiver cover 72 relative to pivot pin 114 and thereby underlying firearm 40. Such considerations ensure the longevity associated with the desired use and accuracy of accessories associated with receiver cover 72.

Figure 10:
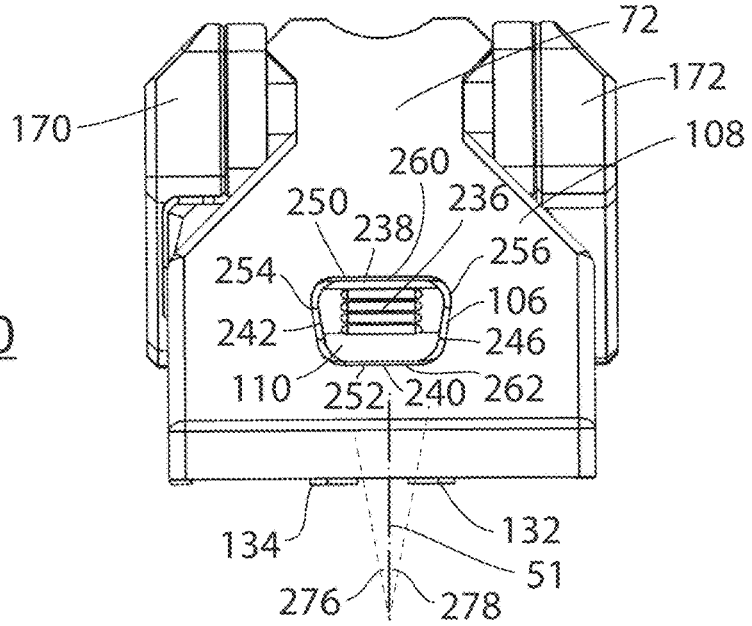
FIG. 10 is a rear elevations view of receiver cover assembly shown in FIG. 5.
Figure 11:
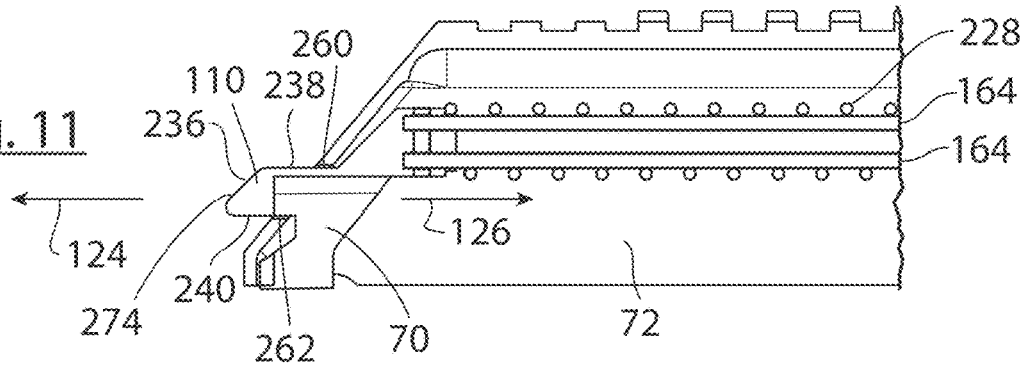
FIG. 11 is a cross sectional view of a latch portion of the receiver cover assembly shown in FIG. 5 taken along line 11-11 shown in FIG. 6.
Figure 12:
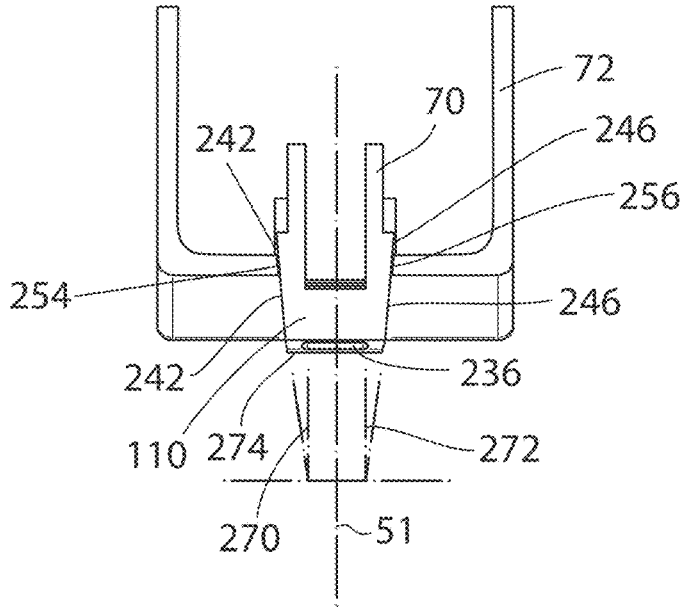
FIG. 12 is a cross sectional view of the latch portion of the receiver cover assembly shown in FIG. 5 taken along line 12-12 shown in FIG. 8.

Referring to FIGS. 8 and 9, once secured to underlying firearm 40, button portion 110 of latch 70 is positioned and shaped to selectively engage and protrude through opening 106 formed in rearward facing surface 108 of body 90 of receiver cover 72 when receiver cover 72 is oriented in the closed position as shown in FIG. 1. Button portion 110 is positioned to be selectively manipulated by a user to allow disengagement of button portion 110 from opening 106 and thereby the selective rotation, indicated by arrow 223, of receiver cover 72 relative to the underlying firearm 40 about axis 118 defined by pivot 114. Referring to FIGS. 10, 11 and 12 and as alluded to above, latch 70 is biased in rearward longitudinal direction 124 by a biasing device such as a spring 228 disposed along spring guide 164 which extends in a forward direction from latch 70. User interaction with button portion 110 allows latch 70 to be translated in forward direction 126, against the bias of spring 228, such that button portion 110 can be disengage from opening 106 defined in rear sidewall 108 of receiver cover 72.

When button portion 110 is disengaged from opening 106 of receiver cover 72, receiver cover 72 may be rotated in an upward and forward direction 223 about pivot pin 114 relative to the underlying firearm 40 thereby exposing those structures generally disposed under the receiver cover 72 when the receiver cover 72 is oriented in the closed position relative to receiver 46. When button portion 110 of latch 70 is depressed by the user, the slidable cooperation of legs 132 of latch 70 with the corresponding channels 142, 144 defined by rear trunnion 66 maintain the relative lateral and vertical orientation of latch 70 relative to the underlying firearm. Said in another way, when depressed, latch 70 translates in a substantially axial direction that is aligned with axis 51 of bore 49 of firearm 40. As disclosed further below, button portion 110 has a generally tapered shape such that a cross-sectional area of a rearward oriented end of button portion 110 has a smaller footprint that forward oriented portions of the button portion 110 of latch 70. Such consideration ensure accurate and repeatable registration of button portion 110 of latch 70 relative to opening 106 associated with receiver cover 72 during cover closing operations and, as disclosed further below, operate to effectuate a desired lateral, vertical, and repeatable alignment of the receiver cover 72 with receiver 46 and the underlying firearm when the receiver cover 72 is oriented in the closed position such that button portion 110 of latch 70 is engaged with opening 106. Such considerations mitigate the necessity of extraneous user manipulation of the resultant assembly to achieve or maintain a desired repeatable vertical and lateral or horizontal alignment of receiver cover 72 with the underlying firearm even during repeated opening and closing operations of the receiver cover 72 relative to the underlying firearm 40.

Button portion 110 of latch 70 is generally defined by a rear wall 236, a top wall 238, a bottom wall 240, and opposing lateral sidewalls 242, 246. Opening 106 defined by rear sidewall 108 of receiver cover 72 includes a top wall 250, a bottom wall 252, and opposing sidewalls 254, 256. When button portion 110 of latch 70 is engaged with opening 106 of receiver cover 72, respective gaps 260, 262 are preferably maintained between the respective top wall 238 and bottom wall 240 of button portion 110 of latch 70 and respective top wall 250 and bottom wall 252 associated with opening 106 of receiver cover 72. Unlike the spaced association between the respective top and bottom walls of button portion 110 and opening 106 disclosed above, when button portion 110 is engaged with opening 106, sidewalls 242, 246 of button portion 110 of latch 70 slideably engage respective sidewalls 254, 256 of opening 106 in a contacting engagement. As shown in FIG. 12, respective sidewalls 242, 246 of button portion 110 of latch 70 are preferably angled toward one another, indicated by angles 270, 272, as the respective sidewalls 242, 246 progress in a rearward direction toward a distal end 274 of button portion 110. Sidewalls 254, 256 defined by opening 106 are preferably also oriented at an angled relation to one another such that sidewalls 242, 246 of button portion 110 and sidewalls 254, 256 engage one another along a substantial portion of the facing surfaces thereof. The angled association associated with the cooperation of button portion 110 and opening 106 ensures lateral alignment between receiver cover 72 and the underlying firearm 40 as button portion 110 is biased into engagement with opening 106 defined by receiver cover 72. Preferably, angles 270, 272 associated with the longitudinally oriented lateral direction taper of each of the opposing lateral sides of button portion 110 and opening 106 is about 10 degrees to about 3 degrees, each plus or minus 2 degrees, relative to longitudinal axis 51. Preferably, each of angles 270, 272 are comparable to one another and/or the same. More preferably each of angles 270, 272 is about 5 degrees relative to firearm longitudinal axis 51 and such that respective sidewalls of button portion 110 and opening 106 are oriented at about a combined 10 degree orientation relative to one another in a fore and aft direction relative to underlying firearm 40. Preferably, sidewalls 254, 256 defined by opening 106 are similarly angled relative to one another and provide an extended surface contact engagement rather than a point of incidence with respective adjoining sidewalls 242, 246 of button portion 110 when button portion 110 is engaged therewith.

Referring briefly back to FIG. 10, sidewalls 242, 246 of button portion 110 and sidewalls 254, 256 defined by opening 106 are each also oriented at an angle, indicated by lines 272, 278, relative to one another in a vertical direction relative to underlying firearm 40 such that the bottom wall of each of opening and button portion extends a shorter distance than the distance associated with the cooperation of top walls 238, 250 of button portion 110 and opening 106, respectively. Preferably, gravitationally vertical angles 276, 278 associated with the vertically oriented lateral direction taper of each of the opposing lateral sides of button portion 110 and opening 106 is also about 10 degrees to about 3 degrees, each plus or minus 2 degrees, relative to an imaginary vertical plane that contains longitudinal axis 51. Preferably, each of angles 270, 272 are comparable to one another and/or the same relative to the vertically extending imaginary plane. More preferably each of angles 270, 272 is about 5 degrees relative to firearm longitudinal axis 51 and such that respective sidewalls of button portion 110 and opening 106 are oriented at about a combined 10 degree direction taper relative to one another in a vertical direction relative to underlying firearm 40 or from a gravitationally vertical or are orthogonal to axis 118 defined by pivot pin 114. Said in another way, each of opening 106 and button portion 110 has a tapered cross-sectional shape that reduces in dimension, in a vertical direction, and a tapered cross-sectional shape that reduces in respective dimensions, as the respective button portion 110 and opening 106 progress in a downward direction away from the upper respective surfaces thereof. The vertical and longitudinal tapered shape of each of button portion 110 and opening 106 allows receiver cover 72 to self-index relative to one another as the receiver cover approaches engagement with the button portion 110 of latch 70. Although shown in FIG. 10 as having a generally inverted trapezoidal shape, it is further appreciated that the vertically tapered shape of button portion 110 and opening 106 could be inverted or otherwise provided with a larger lower lateral dimension and smaller upper lateral dimension and/or provided in other configurations, such as being tapered symmetrical configurations relative to the one or both of the lateral and vertical centerline axis of button portion 110 and a correspondingly shaped opening 106 defined by receiver cover 72. It is appreciated that the laterally and/or vertically tapered shapes of button portion 110 and opening 106, regardless of the relative progressively increasing and/or decreasing lateral and/or vertical mating shapes associated therewith maintain a self-centering and secure positioning of receiver cover 72 relative to receiver 46 when opening 106 is engaged with button portion 110 of latch 70 of a respective receiver cover and latch assembly 42. That is, regardless of the specific respective cross-section shapes, as button portion 110 of latch 70 is biased into engagement with opening 106 of receiver cover 72 under operation of the bias force associated with operation of spring 228, the vertical and longitudinal tapered shape associated with the slideable cooperation of button portion 110 with opening 106 operates to vertically, laterally, and repeatably align receiver cover 72 with the underlying receiver 46 and does so through successive opening and closing operations.

Further still, the vertically and laterally tapered shapes of one or more of button portion 110 and/or opening 106 of receiver cover 72 ensures the repeatability of the vertical and lateral alignment of the receiver cover 72 relative to the receiver 46 and thereby underlying firearm 40 even during wear associated with the slideable cooperation of latch 70 with rear trunnion 69 and button portion 110 with opening 106 without user manipulation thereof. Such considerations ensure repeatable and accurate association of any sighting accessories associated with receiver cover 72 with the underlying firearm 40 to user preset conditions and through successive opening and closing operation of the receiver cover 72 relative to the underlying firearm. Further still, providing no user adjustability to the lateral and/or vertical positioning of the receiver cover 72 relative to the underlying firearm 40, and providing a receiver cover and latch assembly 42 that is automatically indexed relative to the underlying firearm when oriented in the closed position, renders receiver cover and latch assembly 42 as disclosed in the present application as being usable in an interchangeable manner with different firearms of the same type or configuration without requiring user individualization of the same.

Therefore, one embodiment of the present invention discloses a firearm receiver cover and closure assembly that allows the cover to be moved between respective open and closed positions relative to an underlying receiver. The closure assembly includes a latch that defines a latch button that cooperates with a latch button opening formed in the cover. Cooperation of the latch with the receiver and the cooperation of the latch button with the latch opening formed in the cover provide fixed and repeatable vertical and lateral positioning of the cover, and any accessories supported by the cover, relative to the underlying receiver and without adjustment or operation of a centering mechanism or structure, during each closing of the receiver cover relative to the underlying receiver. In a preferred aspect, one or more of the latch button and the latch opening are defined by a frusto-conical, pyramidal, or tapered shapes that slideably cooperate with one another and operate to fix a vertical and lateral orientation of the cover relative to the receiver when the latch button and latch opening are engaged with one another.

Another embodiment of the invention that is usable or combinable with one or more of the features or aspects of the embodiments disclosed above is defined by a firearm closure assembly having a cover that is defined by an elongate body and that is shaped to overlie at least a portion of a receiver of an underlying firearm. The elongate body of the receiver cover has a rearward facing end portion and a forward-facing end portion that is generally opposite the rearward facing end portion of the receiver cover. The forward-facing end portion is constructed to pivotably connect the elongate body of the receiver cover to the underlying firearm. The assembly includes a latch that is constructed to be slideably disposed between the elongate body of the cover and the receiver and is slideable along an axis generally aligned with an elongate axis of the cover and such that the latch is positioned proximate the rearward facing end portion of the elongate body of the cover when engaged therewith. A pushbutton is defined by the latch and an opening is formed in the rearward facing end portion of the cover. The opening in the cover is constructed to slideably cooperate with the pushbutton of the latch so that engagement between the pushbutton of the latch and the opening of the cover defines a lateral position of the cover relative to the receiver when the cover is engaged with the latch.

A further embodiment of the invention that is usable or combinable with the above embodiments includes a firearm assembly having a receiver and a cover constructed to extend along an upper portion of the receiver. The cover is pivotably connected to an underlying firearm so that the cover is pivotable about a forward oriented pivot axis. An opening is formed in a rearward oriented portion of the cover and the assembly includes a latch that is configured to selectively engage the cover. A trunnion block is secured to the receiver and is constructed to engage the latch so that the latch is slideable relative to the trunnion block in a direction that is transverse to an axis of rotation defined by the forward oriented pivot axis. A button is defined by the latch and is shaped to slideably cooperate with the opening formed in the cover so that the cover can rotate about the forward oriented pivot axis in a direction away from the receiver when the button is disengaged from the opening and so that engagement of the button defined by the latch with the opening formed in the cover defines a fixed non-adjustable lateral position and a fixed inclination of the cover relative to the receiver.

Yet another embodiment of the present invention that is usable or combinable with one or more of the above embodiments includes a method of forming a firearm assembly that includes providing a cover that is shaped to overlie a portion of a receiver of a firearm and having a pivot axis formed at a forward oriented end portion of the cover and a latch opening formed at a rearward oriented end portion of the cover. The method includes providing a latch that is shaped to be disposed between the receiver and the cover such that the latch is slideable relative to the cover and the receiver. The latch defines a latch button that removeably cooperates with the latch opening formed in the cover. When engaged with one another, opposing lateral sides of the latch button engage with respective opposing lateral sides of the latch opening defined by the cover to define a fixed lateral position of the cover relative to the latch when the latch button is engaged with the latch opening.

The present invention has been described in terms of the preferred embodiments, the embodiments disclosed herein are directed to the assembly as generally shown in the drawings. It is recognized that equivalents, alternatives, and modifications, aside from those expressly stated, to the embodiments summarized, or the embodiment shown in the drawings, are possible and within the scope of the appending claims. The appending claims cover all such alternatives and equivalents.

What is claimed is:

1. A firearm cover assembly comprising:

a cover defined by an elongate body that is shaped to overlie at least a portion of a receiver of an underlying firearm, the elongate body having a rearward facing end portion and a forward facing end portion that is generally opposite the rearward facing end portion, the forward facing end portion being constructed to pivotably connect the elongate body of the cover to the underlying firearm;

a latch slideably disposed between the elongate body and the receiver and being slideable along an axis generally aligned with an elongate axis of the cover and such that the latch is positioned proximate the rearward facing end portion of the elongate body of the cover;

a pushbutton defined by the latch and that is tapered in a vertical direction and opposing sidewalls that are tapered toward one another in a longitudinal direction along the pushbutton; and an opening formed in the rearward facing end portion of the cover, the opening constructed to slideably cooperate with the pushbutton of the latch so that the cover and the pushbutton directly contact one another along the opposing sidewalls and engagement between the pushbutton of the latch and a surface of the cover that defines the opening of the cover defines a fixed vertical position and a lateral position of the cover relative to the receiver when the cover is engaged with the latch.

2. The firearm cover assembly of claim 1 further comprising an accessory rail formed along at least a portion of an upward directed surface of the cover.

3. The firearm cover assembly of claim 1 further comprising an adjustable rear sight secured to the firearm forward of the forward facing end portion of the cover.

4. The firearm cover assembly of claim 1 further comprising a biasing device engaged with the latch and configured to bias the latch away from a muzzle of the underlying firearm.

5. The firearm cover assembly of claim 4 further comprising a bolt carrier having a chamber constructed to receive the biasing device.

6. The firearm cover assembly of claim 1 further comprising a trunnion constructed to be secured to the receiver and slideably cooperate with the latch generally below the pushbutton.

7. A method of forming a firearm cover assembly comprising:

providing a cover that is shaped to overlie a portion of an underlying receiver of a firearm and having a pivot axis formed at a forward oriented end portion thereof and a latch opening formed at a rearward oriented end portion thereof;

providing a latch shaped to be disposed between the underlying receiver and the cover such that the latch is slideable relative to the cover and the underlying receiver, the latch defining a latch button having opposing lateral sidewalls that are tapered in a vertical direction and longitudinal direction and directly engages and removeably cooperates with the latch opening; and engaging the respective opposing lateral sidewalls of the latch button with respective opposing lateral sides of the latch opening defined by the cover to define a fixed lateral position and vertical position of the cover relative to the latch when the latch button is in contact with and engaged with the latch opening while a gap is maintained between a top and a bottom of the latch button relative to the latch opening.

8. The method of claim 7 further comprising forming an accessory mount rail along a top surface of the cover.

9. The method of claim 8 further comprising providing an adjustable sight secured to the firearm forward of the pivot axis.

10. The method of claim 8 further comprising providing a slide block constructed to be secured to the underlying receiver and engaging the latch with the slide block so that the latch is slideable relative to the underlying receiver in a direction that is transverse to an orientation of the pivot axis of the cover.

11. The method of claim 7 further comprising forming the latch opening and the latch button to have generally matching tapered shapes.

12. The method of claim 7 further comprising forming the latch opening and the latch button so that the latch button cooperates with the latch opening so that the gap between the top and the bottom of the latch button and the latch opening extends in a horizontal direction when the latch button is fully engaged with the latch opening.

* * * * *